US006210852B1

(12) United States Patent
Nakamura

(10) Patent No.: US 6,210,852 B1
(45) Date of Patent: Apr. 3, 2001

(54) TONER DEVELOPMENT OF ELECTROSTATICALLY CHARGED IMAGE

(75) Inventor: Toru Nakamura, Abiko (JP)

(73) Assignee: Ticona GmbH, Kelsterbach (DE)

( * ) Notice: Subject to any disclaimer, the term of this patent is extended or adjusted under 35 U.S.C. 154(b) by 0 days.

(21) Appl. No.: 09/536,545

(22) Filed: Mar. 24, 2000

(51) Int. Cl.[7] ..... G03G 9/097
(52) U.S. Cl. ..... 430/110; 430/109; 430/111
(58) Field of Search ..... 430/110, 111

(56) References Cited

U.S. PATENT DOCUMENTS

| | | | | |
|---|---|---|---|---|
| 5,225,303 | * | 7/1993 | Tomita et al. | 430/110 |
| 5,612,160 | * | 3/1997 | Inoue et al. | 430/110 |
| 5,702,859 | * | 12/1997 | Kubota | 430/110 |
| 5,707,771 | * | 1/1998 | Matsunaga | 430/110 |
| 5,814,428 | * | 9/1998 | Kido et al. | 430/111 |
| 5,866,291 | * | 2/1999 | Ikegami et al. | 430/111 |
| 6,083,654 | * | 7/2000 | Lin | 430/110 |

FOREIGN PATENT DOCUMENTS

| | | |
|---|---|---|
| 0 843 223 | 5/1998 | (EP) . |
| 0 978 766 | 2/2000 | (EP) . |
| 9-152739 | 6/1997 | (JP) . |

* cited by examiner

*Primary Examiner*—Roland Martin
(74) *Attorney, Agent, or Firm*—Frommer Lawrence & Haug LLP

(57) ABSTRACT

A toner for development of an electrostatically charged image including a binder resin, a function imparting agent, a colorant and a charge control agent, wherein said binder resin contains an olefin polymer having a cyclic structure, and a combination of two or more waxes having different melting points in the range of 80 to 140° C. is used as said function imparting agent. A toner for electrostatically charged image developing copiers and printers which has a broad offset-free temperature range and can attain a satisfactory fixability even in the high-speed copying can be provided.

5 Claims, No Drawings

TONER DEVELOPMENT OF ELECTROSTATICALLY CHARGED IMAGE

FIELD OF THE INVENTION

The present invention relates to a toner for heat roller fixing type electrostatically charged image development.

More specifically, the present invention relates to a toner in a developer which is excellent in fixability, anti-spent toner effect and transparency and can form a sharp image when fixing a dry magnetic one-component, dry nonmagnetic one-component, dry two-component, a dry polymerized, liquid dried or liquid toner developer on a copying medium such as paper or a film, which can secure quite a broad temperature range in which a so-called offset phenomenon does not occur (hereinafter referred to as an offset-free temperature range), which is excellent in high-speed fixability and which is satisfactorily put to practical use.

Further, the present invention relates to the toner which can find wide acceptance in copiers, printers, facsimile machines, color copiers, color laser copiers, color laser printers and high speed electrophotographic printers.

BACKGROUND OF THE INVENTION

With the background of the rapid spread of office automation, high-quality or sharp, light-transmissive, well-fixed copied images have been in higher demand than before in electrostatically charged image developing copiers and printers.

One of requirements for such high-quality images is prevention of an offset phenomenon that a toner is not completely fixed on a copying medium such as paper or a film and a part thereof remains on a heat roller and is fixed on a next copying medium to stain the same.

A heat (fixing) roller of a copier is usually heated at 160 to 180° C. in operation. Accordingly, a toner is designed in order to be fixed (bound) at 120 to 190° C. by providing an extra width. The offset phenomenon occurs when a temperature is too high or too low. Thus, for preventing the offset phenomenon and improving the fixability and the sharpness, it is important to secure a toner fixing temperature range which does not cause the offset phenomenon, namely, the offset-free temperature range as broad as possible within said range of 120 to 190° C.

Under these circumstances, the present inventors tried to improve the fixability by selecting a high-viscosity olefin polymer having a cyclic structure as a binder resin for a toner, and further proposed that waxes having a melting point of 60 to 170° C. are added for preventing the offset phenomenon (refer to JP-A-101631/97) . However, the offset-free temperature range so far realized could not reach to the level to be altogether satisfactory enough.

Moreover, the inventors proposed in International Patent publication No. WO 98/29783 specification that the high-viscosity olefin polymer having a cyclic structure is selected as a binder resin for a toner for prevention of the offset phenomenon and a wax selected from amide wax, carnauba wax, higher fatty acids and their esters, higher fatty acid metallic soaps, partially saponified higher fatty acid esters, higher fatty alcohols, polyolefin waxes and paraffin waxes is used. The offset-free temperature range was in the range of 30 to 40° C., and the binder resin could be put to practical use. However, a satisfactory offset-free temperature range being applicable when a binder resin is an olefin polymer having a cyclic structure and a combination of different molecular weights or is made of plural different polymers has not been obtained.

SUMMARY OF THE INVENTION

An object of the present invention is to provide a toner for a dry two-component, dry magnetic one-component, dry nonmagnetic one-component, dry polymerized, liquid dried or liquid toner developer which can more broaden an offset-free temperature range achieved by the invention described in said International Patent Publication No. WO 98/29783 Specification to secure a broad offset-free temperature range being applicable and well suitable for practical use when a binder resin is an olefin polymer having a cyclic structure and a combination of various molecular w eights or is composed of various polymers and which can attain a satisfactory fixability even in the high-speed copying to provide higher-quality or well-fixed, highly light-transmissive, quite sharp copied images of electrostatically charged image developing copiers and printers.

The foregoing object is attained by a toner for development of an electrostatically charged image comprising a binder resin, a function imparting agent, a colorant and a charge control agent, in which the binder resin contains an olefin polymer having a cyclic structure, a combination of two or more waxes having different melting points in the range of 80 to 140° C. is used as the function imparting agent, preferably the difference in the melting point between the wax having the highest melting point and the wax having the lowest melting point is 10 to 40° C. in the combination of two or more waxes, preferably a wax having a polar group and a wax having a nonpolar group are used in the combination of two or more waxes, and preferably the function imparting agent is one of the following combinations (a) to (c) of waxes, (a) a combination of fatty acid amide wax, oxidized polyethylene wax and polyethylene wax, (b) a combination of fatty acid amide wax, oxidized polyethylene wax, polyethylene wax and acid-modified polypropylene wax, and (c) a combination of fatty acid amide wax and acid-modified polypropylene wax.

Further, preferably the olefin polymer having a cyclic structure is composed of a polymer or a polymer fraction having a number average molecular weight of 7,500 or more and a polymer or a polymer fraction having a number average molecular weight of less than 7,500, and in the olefin polymer having a cyclic structure, the content of a polymer or a polymer fraction having a number average molecular weight of 7,500 or more, a weight average molecular weight of 15,000 or more and an intrinsic viscosity (i.v.) of 0.25 dl/g or more is less than 50% by weight based on the entire binder resin, whereby a toner superior in the offset prevention property and the fixability can be provided.

DETAILED DESCRIPTION OF THE INVENTION

The invention is described in detail below.

[I] Components of a Toner (1) Binder Resin

A binder resin is used to fix a toner onto a copying medium such as paper or a film, and it contains an olefin polymer having a cyclic structure as a main component.

A) Olefin Polymer Having a Cyclic Structure

The olefin polymer is a copolymer of an α-olefin (broadly an acyclic olefin) such as a lower alkene having 2 to 12 carbon atoms, preferably 2 to 6 carbon atoms, for example, ethylene, propylene or butylene, and a cyclic and/or polycyclic compound (cycloolefin) having at least one double bond and 3 to 17 carbon atoms, preferably 5 to 12 carbon atoms, such as norbornene, tetracyclododecene, dicyclopentadiene or cyclohexene, especially preferably norbornene or tetracyclododecene, and it is colorless and transparent, and has a high light-transmission.

This olefin polymer having a cyclic structure is a polymer obtained by, for example, a polymerization method using a metallocene catalyst or a Ziegler catalyst and a catalyst for metathesis polymerization, namely double-bond-opening and ring-opening polymerization reactions.

Examples of synthesis of the olefin polymer having a cyclic structure are disclosed in JP-A-339327/93, JP-A-9223/93, JP-A-271628/94, EP-A-203799, EP-A-407870, EP-A-283164, EP-A-156464, and JP-A-253315/95.

According to these examples, the olefin polymer is obtained by polymerizing at least one of the cycloolefin monomers optionally with at least one of the cycloolefin monomers at a temperature of −78 to 150° C., preferably 20 to 80° C. and a pressure of 0.01 to 64 bars in the presence of a catalyst comprising at least one metallocene containing zirconium or hafnium together with a cocatalyst such as aluminoxane. Other useful polymers are described in EP-A-317262, and hydrogenated polymers and copolymers of styrene and dicyclopentadiene are also available.

The metallocene catalyst is activated when dissolved in an inert hydrocarbon such as an aliphatic or aromatic hydrocarbon. Accordingly, the metallocene catalyst is dissolved in, for example, toluene for preliminary activation and reaction in the solvent.

The important properties of the olefin polymer having a cyclic structure are a softening point, a melting point, a viscosity, dielectric properties, an offset-free temperature range and a transparency. These properties can be adjusted advantageously by selecting a ratio of monomers/comonomers, i.e. a ratio of comonomers in a copolymer, molecular weight, molecular weight distribution, hybrid polymers, blends and additives.

The molar ratio of the acyclic olefin and the cycloolefin charged for the reaction can be varied widely depending on the desired olefin polymer having a cyclic structure. This ratio is adjusted preferably to between 50:1 and 1:50, more preferably to between 20:1 and 1:20.

For example, when the copolymer components charged for the reaction are a total of two components, ethylene as an acyclic olefin and norbornene as a cycloolefin, the glass transition point (Tg) of the olefin polymer having the cyclic structure as a reaction product is greatly influenced by their charge proportions. When the content of norbornene is increased, Tg also tends to rise. For example, when the content of norbornene is approximately 60% by weight, Tg is approximately 60 to 70° C.

The physical properties, such as a number average molecular weight, are controlled as known from the literature.

The colorless, transparent, highly light-transmissive olefin polymer having a cyclic structure which is used in the invention comprises a low-viscosity (low-molecular-weight) polymer or polymer fraction (a) and a high-viscosity (high-molecular-weight) polymer or polymer fraction (b) as described below.

That is, the olefin polymer having a cyclic structure may be a mixture of the polymer (a) and the polymer (b). Alternatively, it may have a molecular weight distribution with a single peak, and contain a polymer fraction having a number average molecular weight of less than 7,500 and a polymer fraction having a number average molecular weight of 7,500 or more. Alternatively, it may have two or more peaks in a molecular weight distribution, in which the polymer fraction having at least one of these peaks has a number average molecular weight of less than 7,500 and the polymer fraction having the other peak has a number average molecular weight of 7,500 or more.

The reason why the olefin polymer having a cyclic structure has to comprise the low-viscosity (low-molecular weight) polymer or polymer fraction (a) and the high-viscosity (high-molecular weight) polymer or polymer fraction (b) is that the offset-free temperature range covers both the high temperature side and the low temperature side, so that the fixability of the toner in the high-speed copying are improved and the fixability at low temperatures and low pressures are both improved.

With respect to the polymer or polymer fraction (a) (hereinafter referred to as component (a)),

- a number average molecular weight [measured by GPC (gel permeation chromatography) in terms of polyethylene, which is applied to the following] is less than 7,500, preferably 1,000 to less than 7,500, more preferably 2,000 to less than 7,500;
- a weight average molecular weight is less than 15,000, preferably 1,000 to less than 15,000, more preferably 4,000 to less than 15,000;
- an intrinsic viscosity (i.v., inherent viscosity at 135° C. when 1.0 g of the polymer is uniformly dissolved in 100 ml of decalin) is less than 0.25 dl/g; and
- a glass transition point (Tg) is preferably less than 70° C.

With respect to the polymer or polymer fraction (b) (hereinafter referred to as component (b)),

- a number average molecular weight is 7,500 or more, preferably 7,500 to 50,000;
- a weight average molecular weight is 15,000 or more, preferably 15,000 to 500,000; and
- an intrinsic viscosity (i.v.) is 0.25 dl/g or more.

Further, the content of the component b is less than 50% by weight, preferably 5 to 35% by weight based on the entire binder resin.

The component (b) imparts the structural viscosity to the toner to improve the offset preventing effect and the adhesion of the toner to a copying medium such as paper or a film. However, when t he content is 50% by weight or more, uniform kneading properties are extremely decreased to impair the toner performance That is, a high-quality image, namely, a sharp image with a high fixing strength and excellent heat response cannot be obtained, and mechanical milling properties are decreased, which would make it technically difficult to obtain a necessary particle diameter of the toner.

The polymers or polymer fractions mentioned here refer to respective polymer components before mixing when the olefin polymer having the cyclic structure is composed of a mixture of different components with various number average molecular weights; otherwise they refer to polymer divisions formed by fractionating the final synthetic product by an appropriate method such as GPC. When the polymer fractions are monodisperse or close to monodisperse, the number average molecular weight (Mn) of 7,500 nearly corresponds to the weight average molecular weight (mw) of 15,000.

In order to broaden the offset-free temperature range to the low temperature side, the low-viscosity component (a) constituting the olefin polymer having a cyclic structure can contribute. On the other side, to broaden the offset-free temperature range to the high temperature side, the high-viscosity component (b) can contribute. In order to broaden the offset-free temperature range to the high temperature side more effectively, it is preferred that the high-viscosity component (b) having the number average molecular weight of 20,000 or more is present.

The content of each of the components (a) and (b) constituting the olefin polymer is preferably 0.5 part by weight or more, especially preferably 5 to 100 parts by weight per 100 parts by weight of the entire binder resin. When the content of each component is less than 0.5 part by weight, it is difficult to obtain a practical broad offset-free temperature range.

Since the high-viscosity (high-molecular weight) and low-viscosity (low-molecular weight) olefin polymer having a cyclic structure has the foregoing number average molecular weights (Mn), weight average molecular weights (Mw) and intrinsic viscosities (i.v.), the Mw/Mn ratio indicating the degree of dispersion of the molecular weight distribution is as low as 1 to 2.5, namely, a monodisperse or nearly monodisperse state. Thus, a toner having a quick heat response and a high fixing strength can be produced. This olefin polymer not only enables fixing at a low temperature and a low pressure, but also contributes to the storage stability, the anti-spent toner effect, and the electric stability properties such as uniform charge distribution or constant charging efficiency or charge elimination efficiency. In particular, when the low-viscosity polymer or polymer fraction is monodisperse or nearly monodisperse, the resulting toner shows better heat response characteristics, such as instantaneous melting or setting behavior.

Further, since the olefin polymer having a cyclic structure is colorless and transparent, and has a high light transmission, the polymer can sufficiently be applied to a color toner too. Because an azo pigment "Permanent Rubin F6B" (manufactured by Clariant), for example, was added to this polymer, and the mixture was thoroughly kneaded, and then formed into a sheet with a press.

This sheet was confirmed to be highly transparent. The measurement by the DSC method (differential scanning calorimetry) shows that the olefin polymer has quite a low heat of fusion. Thus, the polymer can be expected to markedly reduce energy consumption for fixing a toner.

B) Modification of an Olefin Polymer Having a Cyclic Structure

Carboxyl groups are introduced into the olefin polymer having a cyclic structure whereby the compatibility with the other resin and the dispersibility of the pigment in the toner can be improved. The introduction of the carboxyl groups can improve the adhesion of the toner to a copying medium such as paper or a film and increase the fixability.

A two-stage reaction method of first polymerizing the olefin polymer having a cyclic structure and then introducing carboxyl groups is advantageous as a method for introducing the carboxyl groups.

At least two methods are available for introducing the carboxyl groups. One is a method of oxidizing an alkyl group such as methyl at the end of the polymer by the fusing air oxidation method to convert it into a carboxyl group. With this method, however, as the olefin polymer having a cyclic structure that has been synthesized using a metallocene catalyst has few branches, it is difficult to introduce many carboxyl groups into the olefin polymer.

Specifically, the carboxyl group is introduced into the olefin polymer having a cyclic structure by graft-polymerizing maleic anhydride, acrylic acid or methacrylic acid using a peroxide such as tert-butanol peroxide as an initiator so that a graft ratio by weight ratio of preferably 1 to 5% by weight, especially of preferably 3 to 5% by weight can be obtained. When the graft ratio is less than 1% by weight, the effect of improving the compatibility is not satisfactory. On the other hand, when it exceeds 5% by weight, the intermolecular crosslinking occurs in the olefin polymer to increase the molecular weight, the kneading properties and the milling properties are not practical, and yellowing extremely occurs to lose clarity. Thus, it is inappropriate for a color toner that has to be colorless and transparent.

The same improvement can be realized by introducing hydroxyl groups or amino groups in a known manner.

To improve the fixability of the toner, a crosslinked structure can be introduced into the olefin polymer having a cyclic structure. One of the methods for introducing this crosslinked structure is that in the polymerization of the olefin polymer, a diene monomer such as cyclopentadiene, cyclohexadiene, norbornadiene, tetracyclododecadiene or butadiene is added together with the acyclic olefin and the cycloolefin for terpolymerization.

As a result of this method, the olefin polymer has a terminal showing an activity even without a crosslinking agent. A known chemical reaction such as oxidation or epoxidation, or the addition of a crosslinking agent to form a crosslinked structure results in the functioning of the olefin polymer.

Another method is to add a metal such as zinc, copper or calcium to the olefin polymer of a cyclic structure having carboxyl groups introduced therein, and then blend and melt the mixture with a screw to disperse the metal as fine particles in the olefin polymer, thereby forming an ionomer having a crosslinked structure. Concerning a technology itself on such an ionomer, U.S. Pat. No. 4,693,941, for example, discloses a terpolymer of ethylene containing carboxyl groups which may take the form of a divalent metal salt upon partial or complete neutralization in an attempt to obtain toughness.

JP-A-500348/94 reports a polyester resin molded product containing an ionomer of an unsaturated carboxylic acid that has approximately 20 to 80% of the carboxylic acid groups neutralized with zinc, cobalt, nickel, aluminum or copper (II), the product intended for the same purpose.

C) Other Components Constituting a Binder Resin

The binder resin may contain resin components other than the olefin polymer having a cyclic structure. Examples thereof include polyester resins such as poly(bisphenol-A) terephthalate; epoxy resins; olefin resins other than the olefin polymer having a cyclic structure, such as an ethylene/propylene copolymer; vinyl acetate resins such as a vinyl acetate resin and an ethylene/vinyl acetate copolymer; and acrylic resins such as a styrene-acrylic resin, or a mixture or a hybrid polymers of any of the mentioned polymers.

In this case, regarding the proportions of the olefin polymer having a cyclic structure and the other resin in the binder resin, it is preferable that the former is 1 to 100 parts by weight and the latter is 99 to 0 parts by weight per 100 parts by weight of the entire binder resin. It is more preferable that the former is 20 to 90 parts by weight and the latter is 80 to 10 parts by weight on the same basis. It is especially preferable that the former is 50 to 90 parts by weight and the latter is 50 to 10 parts by weight on the same basis. When the proportion of the olefin polymer having the cyclic structure is less than 1 part by weight, it becomes difficult to obtain a high-quality image.

(2) Function Imparting Agent

The function imparting agent is incorporated to broaden the offset-free temperature range for more improving the prevention of the offset phenomenon of the toner.

The present invention is characterized by using a combination of two or more waxes having different melting points [peak temperatures measured by the differential scanning calorimetry (DSC)] in the range of 80 to 140° C. When the melting point is less than 80° C., a problem of blocking due to a low-melting product tends to occur in the formation of the toner. On the other hand, since the function imparting agent is required to be completely melted at a kneading temperature at excess of a softening point of a binder resin, the melting point is restricted by the softening point (approximately 135 to 140° C.) of the olefin polymer having a cyclic structure, the main component of the binder resin. Thus, the upper limit of the melting point of the function imparting agent is preferably 140° C.

Specifically, at least two types are used by being selected from fatty acid amide waxes and hydrocarbon waxes described below.

Examples of a wax having a polar group include various fatty acid amide waxes such as arachic acid monoamide (melting point 110° C.), behenic acid moroamide (melting point 115° C.), N,N'-dioleylsebacic acid amide (melting point 115° C.), N,N'-dioleyladipic acid amide (melting point 119° C.) and N,N'-distearylisophthalic acid amide (melting point 129° C.); oxidized olefin waxes such as oxidized polyethylene oxide wax (melting point 116° C.); acid-modified polyolefin waxes such as acid-modified polypropylene wax (melting point 138° C.); and carnauba wax (melting point approximately 80° C.).

Examples of the nonpolar wax (free of a polar group) include olefin waxes being hydrocarbon waxes such as polyethylene wax (melting point 130° C.), polypropylene wax (melting point 120 to 150° C.), paraffin wax (melting point approximately 60 to 80° C.), Sazole wax (solidifying point approximately 98° C.) and microcrystalline wax (melting point 80 to 100° C.).

The combination of two or more types different in melting point from waxes having a melting point in the range of 80 to 140° C. can greatly broaden the offset-free temperature range of the toner to between 50 and 80° C.

Generally, the offset-free temperature range in the toner for development of electrostatically charged images is preferably 70° C. or more as a practical level within the temperature range of 120 to 190° C. or more of a heat roller of a copier. When this temperature range of 120 to 190° C. is shifted to the low temperature side to secure the fixability of the binder resin, the low-temperature fixing can be realized to enable downsizing or energy saving of copiers.

In order to surely broaden the offset-free temperature range, it is preferred to select the waxes such that the difference in the melting point between the wax having the highest melting point and the wax having the lowest melting point in the combination of two or more waxes is 10 to 40° C. The reason may be that the low-melting wax mainly contributes to the offset prevention at the low temperature side and the high-melting wax contributes to the offset prevention at the high temperature side respectively.

When the nonpolar olefin polymer having the cyclic structure is used as a binder resin, it has a lower fixing force than a polar binder resin. Accordingly, it is required to prevent offset at both the low temperature side and the high temperature side. These waxes can meet indeed such a requirement.

Further, in the combination of two or more waxes, it is preferred to use the wax having the polar group and the so-called nonpolar wax free of the polar group in combination.

The polar wax such as fatty acid amide may work as an external lubricant for the nonpolar olefin polymer because of the difference in polarity, whereas the nonpolar polyolefin wax may mainly work as an external lubricant because of easy surface migration due to its low molecular weight, contributing to improved offset-free properties. In other words, the combination of the waxes is for a balance between the dispersion of the waxes themselves in the binder resin and a so-called release effect of preventing the adhesion of the toner onto the heat roller of copiers due to satisfactory migration of the waxes to the toner particle surfaces in the melting.

With respect to the proportions of the polar wax and the nonpolar wax, it is preferable that the former is 100 to 70% by weight and the latter 0 to 30% by weight per 100% by weight in total of both waxes. It is especially preferable that the former is 100 to 75% by weight and the latter 0 to 25% by weight on the same basis.

In consideration of the polarity and the difference in the melting point, the following combinations (a) to (c) are exemplified concerning the preferred combination of waxes and their proportions.

The fatty acid amide wax used is preferably arachic acid monoamide or behenic acid monoamide.

| | |
|---|---|
| (a) Combination of three types | |
| fatty acid amide wax | 25 to 75% by weight |
| oxidized polyethylene wax | 5 to 50% by weight |
| polyethylene wax | 5 to 50% by weight |
| (b) Combination of four types | |
| fatty acid amide wax | 15 to 75% by weight |
| oxidized polyethylene wax | 5 to 50% by weight |
| polyethylene wax | 5 to 50% by weight |
| acid-modified polypropylene wax | 15 to 75% by weight |
| (c) Combination of two types | |
| fatty acid amide wax | 25 to 75% by weight |
| acid-modified polypropylene wax | 25 to 75% by weight |

Further, with respect to the particle diameter of the wax which is a function imparting agent used for production of the toner, it is preferable that the wax having the low polarity has a smaller particle diameter than the wax having the high polarity. This is because the dispersibility of the wax having the low polarity in a toner using an olefin polymer having a cyclic structure as a binder resin is relatively high and the particle diameter of the wax having the low polarity is therefore fined to physically improve the dispersibility and enhance the surface migration property.

Specific examples thereof are as follows.

(a) Polar wax:

fatty acid monoamide wax having d50 (particle diameter of 50% by weight) of preferably 5 to 500 μm, more preferably 5 to 250 μm, oxidized polyethylene wax having d50 of preferably 3 to 50 μm, more preferably 3 to 10 μm.

(b) Mixed wax of polar and nonpolar waxes:

oxidized polyethylene/polyethylene mixed wax having d90 (particle diameter of 90% by weight) of preferably 3 to 100 μm, more preferably 3 to 15 μm, having d50 of preferably 3 to 50 μm, more preferably 3 to 10 μm.

(c) Nonpolar wax:

polyethylene wax having d50 of preferably 3 to 50 μm, more preferably 3 to 10 μm.

(3) Colorant

As a colorant, those which are ordinarily used in a toner for monochromic or color copiers can be used in the toner of the present invention. Examples thereof include carbon black, diazo yellow, phthalocyanine blue, quinacridone, carmine 6B, monoazo red and perylene.

(4) Charge Control Agent

As a charge control agent, those which have been so far known can be used in the toner of the present invention. Examples thereof include Nigrosine dyes, fatty acid-modified Nigrosine dyes, metallized Nigrosine dyes, metallized fatty acid-modified Nigrosine dyes, chromium complexes of 3,5-di-tert-butylsalicylic acid, quaternary ammonium salts, triphenylmethane dyes and azochromium complexes.

(5) Other Additives

In addition to the aforementioned components constituting the toner, there may be added, if desired, to the toner of the invention a flowing agent such as colloidal silica (including fumed silica), aluminum oxide or titanium oxide and a lubricant comprising a fatty acid metal salt such as barium stearate, calcium stearate or barium laurate, so far as attainment of the intended effects of the present invention is not inhibited.

[II] Dosages of Components

The dosages of the components of the toner in the invention are the same as those in the general formulation of the toner for electrostatically charged image developing copiers and printers as shown in Table 1.

TABLE 1

General formulation of toners (unit:wt. %)

| | Binder resin | Colorant | Charge control agent | Function imparting agent | Magnetic powder | Solvent |
|---|---|---|---|---|---|---|
| Dry two-component toner | 50–100 | 0–20 | 0–10 | 0–20 | — | — |
| Dry nonmagnetic one-component toner | 50–100 | 0–20 | 0–10 | 0–20 | — | — |
| Dry magnetic one-component toner | 0–100 | 0–20 | 0–10 | 0–20 | 0–60 | — |
| Dry polymerized toner | 50–100 | 0–20 | 0–10 | 0–20 | — | — |
| Liquid dried toner | 15–50 | 0–10 | 0–5 | 0–10 | — | 50–70 |
| Liquid toner | 15–50 | 0–10 | 0–5 | 0–10 | — | 50–70 |

[III] Preparation of Toners

The toner of the present invention can be obtained by mixing a binder resin with a function imparting agent, a colorant, a charge control agent and further, if desired, additives such as a flowing agent and a lubricant, and by known methods, such as, for example, kneading, grinding and classification as specifically described below.

That is, the preparation of a dry nonmagnetic one-component toner and a dry two-component toner is described below. One % by weight of a charge control agent, a total of 4% by weight of two or more waxes with different in the melting point as a function imparting agent, 5% by weight of a colorant and 89.5% by weight of an olefin polymer having a cyclic structure as a binder resin are kneaded at 120° C. The resulting composition is coarsely crushed, and then finely divided with a laboratory jet mill to obtain toner particles having an average particle diameter of approximately 8 μm. Subsequently, 0.5% by weight of aerosol silica is externally added thereto. Thus, a final toner can be obtained.

The preparation of a dry magnetic one-component toner is described below. Forty % by weight of a magnetic powder ("BL100" manufactured by Titanium Industry), 1% by weight of a charge control agent ("Copy Charge NX" manufactured by Clariant), a total of 4% by weight of two or more waxes with different in the melting point as a function imparting agent, 2.0% by weight of calcium carbonate (manufactured by Shiraishi Calcium) as an extender pigment and a structural viscosity modifier, 5% by weight of carbon black ("MA-7" manufactured by Mitsubishi Chemical Corporation) as a colorant and 47.5% by weight of an olefin polymer having a cyclic structure to be described later as a binder resin are kneaded with a kneader ("Rheomix 600" manufactured by Haake) at 120° C. for 3 minutes. The resulting composition is coarsely crushed with Osterizer (manufactured by Oster), and finely divided with a laboratory jet (Nippon Neuman) to obtain toner particles having an average particle diameter of 8 μm. Then, 0.5% by weight of fumed silica ("HDK-2000" manufactured by Wacker Chemie) is externally added thereto. Thus, a final toner can be obtained.

The preparation of a dry polymerized toner is described below. One % by weight of a charge control agent, a total of 4% by weight of two or more waxes as a function imparting agent, 0.5% by weight of fumed silica and 5% by weight of a colorant (magenta pigment) are mechanically dispersed and mixed in monomer components corresponding to 89.5% by weight of a binder resin at the same time of polymerization of the binder resin. The mixture is interfacially polymerized and then the particles produced thereby with an average particle diameter of approximately 10 μm can be obtained.

The preparation of a liquid dried toner is described below. Forty % by weight of the toner obtained according to the above-mentioned formulation of the dry polymerized toner and 60% by weight of an electrolytic solution are mixed, and the mixture is kneaded with a sand mill. Thus, a final toner can be obtained.

The preparation of a liquid toner is described below. Forty % by weight of a toner comprising 1 part by weight of carbon black as a colorant, 0.5 part by weight of a charge control agent and 98.5 parts by weight of a binder resin are mixed with 60% by weight of an electrolytic solution, and the mixture is kneaded with a sand mill. Thus, a final toner can be obtained.

EXAMPLES

The present invention will now be explained more specifically by referring to Examples and Comparative Examples. However, the invention is not limited to these Examples at all.

(1) Starting Materials a) Olefin polymer having a cyclic structure

An olefin polymer "T-910" having a cyclic structure is obtained by uniformly mixing 25% by weight of a polymer component having a high molecular weight (high viscosity) with 75% by weight of a polymer component having a low molecular weight (low viscosity) . The physical properties of the olefin polymer itself are that the number average molecular weight (Mn) is 8,340, the weight average molecular weight (Mw) is 35,800, the molecular weight distribution (Mw/Mn) is 4.29, the glass transition point (Tg, temperature corresponding to the middle point of displacement showing heat of transition as measured by the DSC method) is 65.6° C., and a ratio of an oligomer (composition of a component having Mw of less than 1,000 as measured by the GPC method) is 1.63%.

The high-molecular weight polymer components are as follows.

Monomers: acyclic olefin—ethylene cycloolefin—norbornene

Number average molecular weight (Mn): 35,000

Weight average molecular weight (Mw): 70,000

Viscosity number (VN): 130

Molecular weight distribution (Mw/Mn): 2.0

Glass transition point (Tg): 65° C.

The low-molecular-weight polymer components are as follows.

Monomers: acyclic olefin—ethylene cycloolefin—norbornene

Number average molecular weight (Mn): 3,600

Weight average molecular weight (Mw): 6,400

Viscosity number (VN): 17

Molecular weight distribution (Mw/Mn): 1.8

Glass transition point (Tg): 65 to 66° C.

Methods for measuring physical properties of the polymer are as follows.

GPC conditions for measurement of molecular weight:

Molecular weight conversion method:

Standard polyethylene is used.

Column used: JORDI-SAEULE 500×10 LINEAR

Mobile phase: 1,2-dichlorobenzene (135° C.)

(flow rate 0.5 ml/min)

Detector: Differential refractometer

A method for measuring an intrinsic viscosity is as follows.

It is a reduced viscosity (VN) at 135° C. when 1.0 g of the polymer is uniformly dissolved in 100 ml of decalin, and calculated by the following formula.

$$VN=\eta_{sp}/c$$

wherein $\eta_{sp}=\eta_r-1$, $\eta_r=\eta/\eta_0$, $\eta$ is a viscosity of a polymer solution, $\eta_0$ is a viscosity of a solvent and c is a polymer concentration.

The intrinsic viscosity is a value calculated by extrapolating a polymer concentration, c=0.

b) Function imparting agent

Waxes used as a function imparting agent are shown in Table 2.

TABLE 2

| Function imparting agent | | | | | | |
|---|---|---|---|---|---|---|
| Type | Product | Company | Compound | DSC peak Temperature (° C.) | Acid Value (mg·KOH/g) | Remarks |
| A | BNT22H | Nippon Seika | behenic acid amide wax | 115 | <1 | (1) |
| B | Ceridust 3715 | Clariant | fine particles of a mixture of oxidized polyethylene wax and polyethylene wax | 128 | 4 | (2) |
| C | Ceridust 3719 | Clariant | fine particles of a mixture of oxidized polyethylene wax and polyethylene wax | 128 | 18 | (3) |
| D | Umex 1010 | Sanyo Kasei | Acid-modified polypropylene wax | 138 | Acid modification ratio 10% | (4) |
| E | A-20 | Nippon Seika | arachic acid amide wax | 110 | <1 | (5) |
| F | PED-121 | Clariant | oxidized polyethylene wax | 116 | 10 | (6) |
| G | PE-130 | Clariant | polyethylene wax | 130 | 0 | (7) |

Remarks:

(1) Particle diameter: 500 μm or less d50: approximately 250 μm (2) Mixture of approximately 50% by weight of oxidized polyethylene wax and approximately 50% by weight of polyethylene wax d50: approximately 9 μm d90: approximately 15 μm (3) Mixture of approximately 50% by weight of oxidized polyethylene wax and approximately 50% by weight of polyethylene wax d50: approximately 9 μm d90: approximately 15 μm (4) Granules (5) Particle diameter: 500 μm or less d50: approximately 250 μm (6) Particle diameter: 500 μm or less d50: approximately 250 μm (7) Particle diameter: 500 μm or less d50: approximately 250 μm c) Colorant Carbonblack "MA-7" manufacturedby Mitsubishi Chemical Corporation.

d) Charge control agent

"Copy Charge NX" manufactured by Clariant e) Fumed silica

"HDK-2000" manufactured by Wacker Chemie (2) Preparation of a Toner

A dry nonmagnetic one-component toner and a dry two-component toner were prepared as follows.

One % by weight of a charge control agent, a total of 4% by weight of a combination of function imparting agents shown in Table 3, 5% by weight of a colorant and 89.5% by weight of an olefin polymer having a cyclic structure as a binder resin were kneaded with a kneader ("Rheomix 600" manufactured by Haake) at a temperature of 120° C. for 3 minutes. The resulting compound was coarsely crushed with "Osterizer" (manufactured by Oster), and then finely divided with a laboratory jet (manufactured by Nippon Newman) to obtain toner particles having an average particle diameter of 8 μm. Subsequently, 0.5% by weight of fumed silica was externally added thereto with the "Osterizer" to obtain a final toner. The formulation is shown in Table 3.

A dry two-component toner is one obtained by mixing the dry nonmagnetic one-component toner with an iron oxide powder carrier.

TABLE 3

| Formulation of a toner (unit: wt. %) | | | | | | | | | | | |
|---|---|---|---|---|---|---|---|---|---|---|---|
| | Binder resin | Carbon | Charge control | Function imparting agent | | | | | | | Fumed |
| No. | (T-910) | black | agent | A | B | C | D | E | F | G | silica |
| 1 | 89.5 | 5 | 1 | 2 | — | — | 2 | — | — | — | 0.5 |
| 2 | 89.5 | 5 | 1 | 2 | 2 | — | — | — | — | — | 0.5 |
| 3 | 89.5 | 5 | 1 | 1.33 | 1.33 | — | 1.33 | — | — | — | 0.5 |
| 4 | 89.5 | 5 | 1 | 2 | — | 2 | — | — | — | — | 0.5 |
| 5 | 89.5 | 5 | 1 | 1.33 | — | 1.33 | 1.33 | — | — | — | 0.5 |
| 6 | 89.5 | 5 | 1 | 4 | — | — | — | — | — | — | 0.5 |
| 7 | 89.5 | 5 | 1 | — | 4 | — | — | — | — | — | 0.5 |
| 8 | 89.5 | 5 | 1 | — | — | — | 4 | — | — | — | 0.5 |

TABLE 3-continued

Formulation of a toner (unit: wt. %)

| No. | Binder resin (T-910) | Carbon black | Charge control agent | Function imparting agent A | B | C | D | E | F | G | Fumed silica |
|---|---|---|---|---|---|---|---|---|---|---|---|
| 9 | 89.5 | 5 | 1 | — | — | — | — | 4 | — | — | 0.5 |
| 10 | 89.5 | 5 | 1 | — | — | — | — | — | 4 | — | 0.5 |
| 11 | 89.5 | 5 | 1 | — | — | — | — | — | — | 4 | 0.5 |

(3) Evaluation (test) Methods a) Toner fixability

Using the toners shown in Tables 4 and 5, images were formed on a sheet of high quality paper with a copier "FT-5520" manufactured by Ricoh Co., Ltd. as to the dry magnetic two-component toner and a copier "PC30" manufactured by Canon Inc. as to the dry nonmagnetic one-component toner. A sheet of the same quality paper unprinted was put thereon. The printed surface was rubbed with a rubbing tester, and the soil by rubbing were forcibly transferred onto the unprinted paper. At this time, the reciprocative rubbing was conducted 20 times under load of 450 g.

With respect to the fixing rate, low-speed rotation at a rate of 100 mm/sec (45 rpm) and 50 mm/sec (22 rpm) and high-speed rotation at a rate of 150 mm/sec (67 rpm) were employed, and the fixing temperatures were set at 120° C., 150° C. and 190° C.

After the rubbing, an initial image density (A) before the rubbing, a transfer density (B) on unprinted paper and a density (C) of a non-image area of paper were measured using a Macbeth reflection densitometer, and a transfer ratio was calculated by the formula $[(B-C)/A]\times 100(\%)$ . The results are shown in Tables 4 and 5. In these tables, the symbols indicate the following transfer ratios.

○: less than 5%

Δ: 5% or more but less than 10% x: 10% or more

TABLE 4

Toner fixability test (dry two-component toner)

| | Formulation No. | Fixing rate 100 mm/sec 120° C. | 190° C. | 150° C. | Fixing rate 50 mm/sec 120° C. | 190° C. | Fixing rate 150 mm/sec 120° C. | 190° C. |
|---|---|---|---|---|---|---|---|---|
| Ex. 1 | 1 | O | O | O | O | O | O | O |
| Ex. 2 | 2 | O | O | O | O | O | O | O |
| Ex. 3 | 3 | O | O | O | O | O | O | O |
| Ex. 4 | 4 | O | O | O | Δ | O | O | O |
| Ex. 5 | 5 | O | O | O | O | O | O | O |
| Comp. Ex. 1 | 6 | Δ | X | O | Δ | X | Δ | X |
| Comp. Ex. 2 | 7 | X | X | O | X | X | X | X |
| Comp. Ex. 3 | 8 | X | Δ | O | X | Δ | X | Δ |
| Comp. Ex. 4 | 9 | O | X | Δ | O | X | O | X |
| Comp. Ex. 5 | 10 | O | Δ | O | O | Δ | O | Δ |
| Comp. Ex. 6 | 11 | Δ | X | O | Δ | X | Δ | X |

TABLE 5

Toner fixability test (dry nonmagnetic one-component toner)

| | Formulation No. | Fixing rate 100 mm/sec 120° C. | 190° C. | 150° C. | Fixing rate 50 mm/sec 120° C. | 190° C. | Fixing rate 150 mm/sec 120° C. | 190° C. |
|---|---|---|---|---|---|---|---|---|
| Ex. 6 | 1 | O | O | O | O | O | O | O |
| Ex. 7 | 2 | O | O | O | O | O | O | O |
| Ex. 8 | 3 | O | O | O | O | O | O | O |
| Ex. 9 | 4 | O | O | O | Δ | O | O | O |
| Ex. 10 | 5 | O | O | O | O | O | O | O |
| Comp. Ex. 7 | 6 | Δ | X | O | Δ | X | Δ | X |
| Comp. Ex. 8 | 7 | X | X | O | X | X | X | X |
| Comp. Ex. 9 | 8 | X | Δ | O | X | Δ | X | Δ |

TABLE 5-continued

| | Toner fixability test (dry nonmagnetic one-component toner) | | | | | | | |
|---|---|---|---|---|---|---|---|---|
| | Formulation | Fixing rate 100 mm/sec | | | Fixing rate 50 mm/sec | | Fixing rate 150 mm/sec | |
| | No. | 120° C. | 190° C. | 150° C. | 120° C. | 190° C. | 120° C. | 190° C. |
| Comp. Ex. 10 | 9 | O | X | Δ | O | X | O | X |
| Comp. Ex. 11 | 10 | O | Δ | O | O | Δ | O | Δ |
| Comp. Ex. 12 | 11 | Δ | X | O | Δ | X | Δ | X |

b) Test for offset-free properties

Using the toners shown in Tables 6 and 7, images were formed on plain paper with a copier "FT-5520" manufactured by Ricoh Co., Ltd. as to the dry magnetic two-component toner and a copier "PC30" manufactured by Canon Inc. as to the dry nonmagnetic one-component toner. Subsequently, an offset phenomenon occurring through migration of the toner onto a heat roller surface of the copier was evaluated using a copier for evaluation in which a roller surface temperature and a roller feed rate of a heat roller-type fixing unit mounted on the copier can be controlled.

Copying of 10 sheets was repeated at a fixing rate of 100 mm/sec (45 rpm) and at a fixing temperature of 100 to 200° C. with the fixing temperature being raised at intervals of 10° C. The offset phenomenon was visually observed, and the temperature ranging from the lowest temperature to the highest temperature in which the offset phenomenon did not occur was defined as the offset-free temperature range.

Further, with respect to the fixing rate, low-speed rotation at a rate of 50 mm/sec (22 rpm) and high-speed rotation at a rate of 150 mm/sec (67 rpm) were employed, and the offset phenomenon was visually observed at 120° C. and 190° C. respectively.

The results are shown in Tables 6 and 7. In these tables, the symbols indicate the following.

○: Offset phenomenon did not occur.

x: Offset phenomenon occurred.

TABLE 6

| | Test for offset-free properties (dry two-component toner) | | | | | | | |
|---|---|---|---|---|---|---|---|---|
| | Formulation | Offset-free temperature range (100 mm/sec) | | | 50 mm/sec | | 150 mm/sec | |
| | No. | Low temperature (° C.) | High temperature (° C.) | Temperature difference (° C.) | 120° C. | 190° C. | 120° C. | 190° C. |
| Ex. 1 | 1 | 120 | 190 | 70 | O | O | O | O |
| Ex. 2 | 2 | 120 | 190 | 70 | O | O | O | O |
| Ex. 3 | 3 | 120 | 190 | 70 | O | O | O | O |
| Ex. 4 | 4 | 120 | 190 | 70 | X | O | O | O |
| Ex. 5 | 5 | 120 | 190 | 70 | O | O | O | O |
| Comp. Ex. 1 | 6 | 120 | 150 | 30 | X | X | O | X |
| Comp. Ex. 2 | 7 | 120 | 150 | 30 | O | X | O | X |
| Comp. Ex. 3 | 8 | 120 | 150 | 30 | X | X | X | X |
| Comp. Ex. 4 | 9 | 110 | 140 | 30 | X | X | O | X |
| Comp. Ex. 5 | 10 | 110 | 140 | 30 | X | X | X | X |
| Comp. Ex. 6 | 11 | 130 | 150 | 20 | X | X | X | X |

TABLE 7

Test for offset-free properties (dry nonmagnetic one-component toner)

| | Formulation No. | Offset-free temperature range (100 mm/sec) Low temperature (° C.) | High temperature (° C.) | Temperature difference (° C.) | 50 mm/sec 120° C. | 50 mm/sec 190° C. | 150 mm/sec 120° C. | 150 mm/sec 190° C. |
|---|---|---|---|---|---|---|---|---|
| Ex. 6 | 1 | 120 | 190 | 70 | O | O | O | O |
| Ex. 7 | 2 | 120 | 190 | 70 | O | O | O | O |
| Ex. 8 | 3 | 120 | 190 | 70 | O | O | O | O |
| Ex. 9 | 4 | 120 | 190 | 70 | X | O | O | O |
| Ex. 10 | 5 | 120 | 190 | 70 | O | O | O | O |
| Comp. Ex. 7 | 6 | 120 | 150 | 30 | X | X | O | X |
| Comp. Ex. 8 | 7 | 120 | 150 | 30 | O | X | O | X |
| Comp. Ex. 9 | 8 | 120 | 150 | 30 | X | X | X | X |
| Comp. Ex. 10 | 9 | 110 | 140 | 30 | X | X | O | X |
| Comp. Ex. 11 | 10 | 110 | 140 | 30 | X | X | X | X |
| Comp. Ex. 12 | 11 | 130 | 150 | 20 | X | X | X | X |

The toner for development of electrostatically charged images in the invention contains the olefin polymer having a cyclic structure as a binder resin and uses the two or more waxes with different melting point, whereby the broad offset-free temperature range suitable for practical use is secured in various toners (dry two-component toner, dry magnetic one-component toner, dry nonmagnetic one-component toner, dry polymerized toner, liquid dried toner and liquid toner), and further the satisfactory fixability is attained in high-speed copying to obtain high-quality copied images.

What is claimed is:

1. A toner for development of an electrostatically charged image comprising a binder resin, a function imparting agent, a colorant and a charge control agent, wherein said binder resin contains an olefin polymer having a cyclic structure, and a combination of two or more waxes having different melting points in the range of 80 to 140° C. is used as said function imparting agent.

2. The toner for development of an electrostatically charged image according to claim 1, wherein in said combination of two or more waxes as the function imparting agent, the difference in the melting point between the wax having the highest melting point and the wax having the lowest melting point is 10 to 40° C.

3. The toner for development of an electrostatically charged image according to claim 1, wherein in said combination of two or more waxes as the function imparting agent, at least one wax having a polar group is used in combination with at least one nonpolar wax.

4. The toner for development of an electrostatically charged image according to claim 1, wherein the function imparting agent is one selected from the group consisting of the following combinations (a) to (c) of waxes, (a) a combination of fatty acid amide wax, oxidized polyethylene wax and polyethylene wax, (b) a combination of fatty acid amide wax, oxidized polyethylene wax, polyethylene wax and acid-modified polypropylene wax, and (c) a combination of fatty acid amide wax and acid-modified polypropylene wax.

5. The toner for development of an electrostatically charged image according to claim 1, wherein said olefin polymer having a cyclic structure is composed of a polymer or a polymer fraction having a number average molecular weight of 7,500 or more and a polymer or a polymer fraction having a number average molecular weight of less than 7,500, and in said olefin polymer having a cyclic structure, the content of a polymer or a polymer fraction having a number average molecular weight of 7,500 or more, a weight average molecular weight of 15,000 or more and an intrinsic viscosity (i.v.) of 0.25 dl/g or more is less than 50% by weight based on the entire binder resin.

* * * * *